United States Patent [19]

Mosholder

[11] Patent Number: 4,563,075

[45] Date of Patent: Jan. 7, 1986

[54] DEVICE FOR PRESSURE FUSING IMAGES ON TO PAPER IN ELECTROSTATIC COPIERS

[75] Inventor: Michael B. Mosholder, Powell, Ohio

[73] Assignee: Tokyo Shibaura Denki Kabushiki Kaisha, Japan

[21] Appl. No.: 545,462

[22] Filed: Oct. 25, 1983

[51] Int. Cl.[4] ..... G03G 15/20

[52] U.S. Cl. ..... 355/3 FU; 430/98

[58] Field of Search ..... 355/3 FU, 14 FU, 3 R; 219/216, 388; 430/98; 100/158 R

[56] References Cited

U.S. PATENT DOCUMENTS

| | | | |
|---|---|---|---|
| B 493,501 | 2/1976 | Root | 355/3 FU |
| 3,931,793 | 1/1976 | Kolibas | 355/3 FU |
| 4,192,229 | 3/1980 | Tsunoi | 100/158 |
| 4,200,389 | 4/1980 | Matsui | 355/3 |
| 4,315,682 | 2/1982 | Parzanici | 355/3 |
| 4,335,951 | 6/1982 | Scribner | 355/3 |
| 4,363,862 | 12/1982 | Giorgini | 430/98 |

*Primary Examiner*—R. L. Moses

*Attorney, Agent, or Firm*—Banner, Birch, McKie & Beckett

[57] ABSTRACT

This invention relates to a device for pressure fusing dry, powdered toner particles to a copy sheet in an electrostatic copier. The pressure fusing device comprises a rigid member against which fusing pressure can be applied and a plurality of independent, freely movable rollers for applying fusing pressure to a copy sheet.

12 Claims, 5 Drawing Figures

DEVICE FOR PRESSURE FUSING IMAGES ON TO PAPER IN ELECTROSTATIC COPIERS

BACKGROUND OF THE INVENTION

This invention relates to electrostatic copiers that produce an image by depositing a dry, powdered toner on paper. The invention relates specifically to a device for pressure fusing the toner image to the paper.

In most copying machines, the copying machine forms an optical image of the material to be copied which is projected onto the surface of a sensitized semi-conductor, forming an electrostatic image. A dark color, electrostatically sensitive, powdered material, called toner, is brought into contact with the sensitized semi-conductor. Toner particles adhere to the areas on the semi-conductor where an electrostatic charge is present. The toner particles, maintaining the pattern formed on the semi-conductor, then are transferred to a sheet of paper. The toner particles are bonded to the paper, forming a permanent reproduction of the material being copied.

Three basic methods have been used to bond the toner to the paper: solvent fusing, thermal fusing and pressure fusing. In addition a combination of heat and pressure have been found to be effective. Solvent fusing is least desirable because personnel can be exposed to harmful solvent vapors. Thermal fusing, or the combination of heat and pressure to fuse the tone, is the most commonly used technique. However, with any thermal base operation, power consumption and warm-up time are significant. Pressure only fusing has not been used extensively because there have been no good pressure fixable toners that will operate with plain paper at pressures less than 200 to 300 pounds per linear inch (pli). At these pressures, the size, weight and cost of the pressure applying elements become significant factors in a copying machine.

In prior art electrostatic copiers that use pressure fusing devices to fix or fuse the toner image to paper, the paper with an unfused image of loosely adhereing toner particles is passed between two parallel rolls that are pressed together. Generally, the rolls are supported at their ends on bearings. Most often, only one of the rolls is driven, the second roll being an idler roll. Usually the rolls are of equal diameter and, hence, are driven at equal surface velocities. In order to achieve essentially uniform fusing pressures along their entire length, the rolls are of relatively large diameter so that their deflection can be low.

SUMMARY OF THE INVENTION

The invention described and claimed herein overcomes the disadvantages of the prior art by using a plurality of rollers having overlapping surface contacts as pressure applying elements. According to the present invention, a pressure fixing device for a copying machine includes a rigid member for providing a rigid surface against which fusing pressure can be applied in order to pressure fuse an image onto a copy sheet. In a preferred embodiment of the invention, the rigid member may be a driven roller for conveying a copy sheet. A housing is provided adjacent to the rigid member. The housing and rigid member form a pressure fusing space through which a copy sheet passes. Where two pressure fusing rolls are used, this space is conventionally referred to as a nip.

According to the invention, the housing may include a self-lubricating bearing surface against which rollers are retained. A plurality of independent freely movable rollers are retained in the housing for contacting the copy sheet and applying a fusing pressure to the copy sheet. The rollers are positioned in the housing so that the contact areas of the rollers on the copy sheet overlap. Preferably each of the rollers is not touching any adjacent roller. This helps to reduce wear and friction among the rollers and thus allows a smaller pressure force to be applied. In a preferred form, the rollers are steel balls, although it will be appreciated that other forms of rollers may also be used. In one embodiment the balls are arranged in a plurality of rows with the center point of the balls in each row offset from the center point of the balls in each of the other rows.

DESCRIPTION OF THE PREFERRED EMBODIMENT

Figure 1:
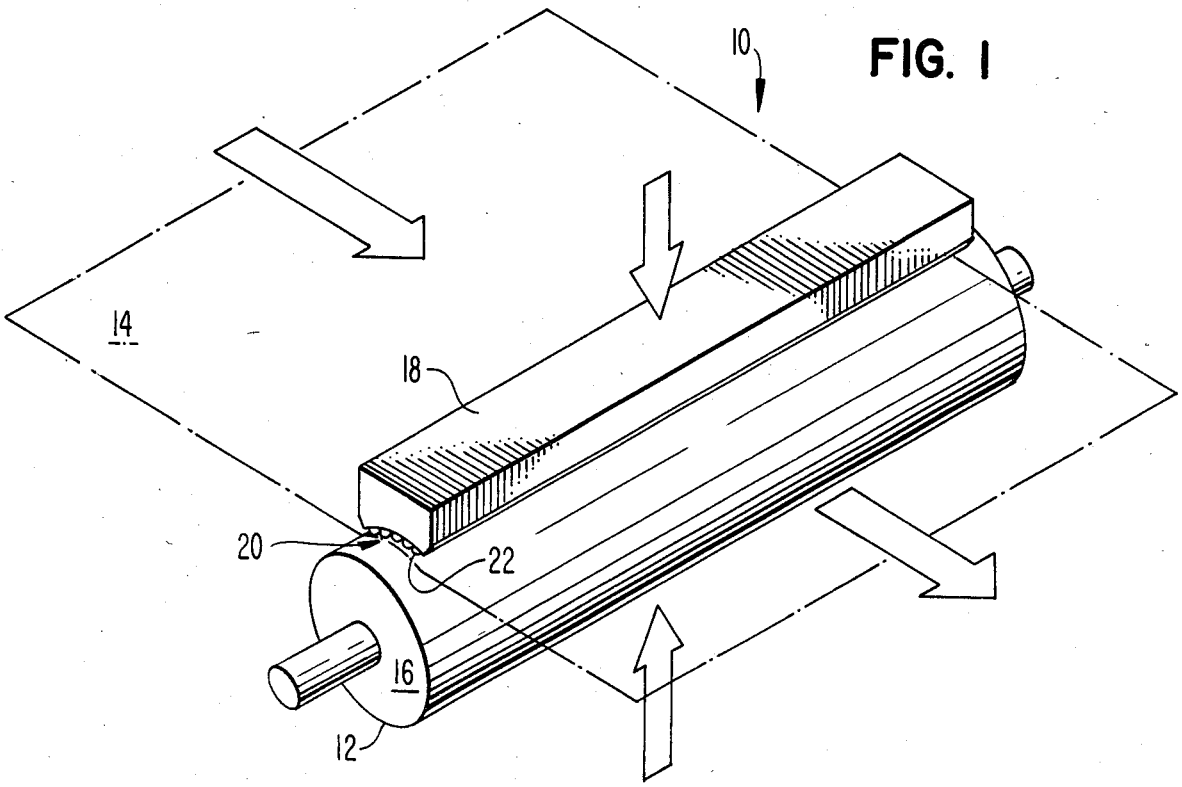
FIG. 1 is a general perspective view of a pressure fixing device according to the invention including a copy sheet being conveyed through the pressure fixing device.
Figure 3:
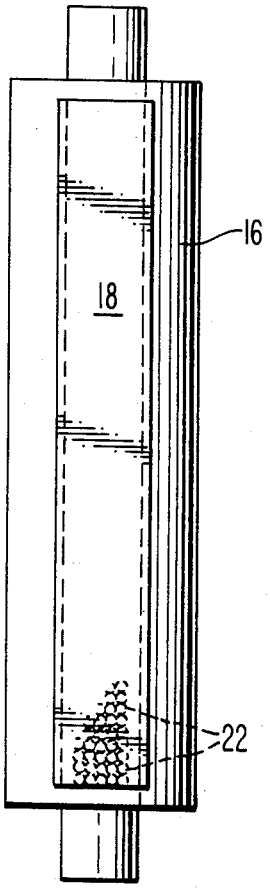
FIG. 3 is a top view of a pressure fixing device of FIG. 1.
Figure 2:
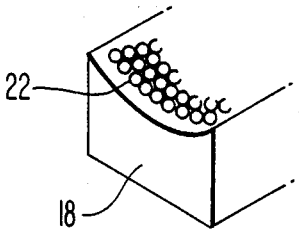
FIG. 2 is a cut-away perspective view of the inside surface of the housing according the the invention, showing roller elements mounted in the housing.
Figure 4:
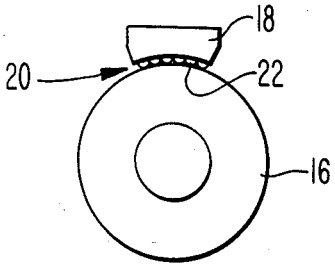
FIG. 4 is a side view of FIG. 3.

A pressure fixing device according to the invention is shown generally at 10. The pressure fixing device includes a rigid member 12 for providing a rigid surface against which fusing pressure can be applied in order to pressure fuse an image onto a copy sheet, illustrated generally at 14. Preferably, rigid member 12 is a driven roller 16 for conveying sheet 14 on which an image is to be fixed. Roller 16 may be driven in any conventional manner, such as by gears, chain sprockets, direct drive, or otherwise.

Pressure fixing device 10 also includes a housing 18 adjacent to roller 16. Housing 18 forms a pressure fusing space, sometimes referred to as a nip, shown generally at 20, where roll 16 and housing 18 form a region for applying compressive force to copy sheet 14. Preferably, housing 18 is constructed from a material with suitable wear and lubrication characteristics, such as any of the well known self-lubricating bearing materials.

A plurality of independent, freely movable rollers 22 are retained in housing 18. Rollers 22 contact copy sheet 14 and apply a fusing pressure to copy sheet 14. Copy sheet 14 with toner applied to it passes between roller 16 and the plurality of rollers 22. Preferably rollers 22 are small steel balls, although other rollers may of course be used. Because each individual ball is in contact with a small area of the copy sheet 14, small loads on each ball produce high unit pressures, which are adequate to fuse toner to copy sheet 14. The number of balls and the patterns in which they are arranged should be such that the contact areas of the balls overlap to ensure the application of pressure to the entire area of copy sheet 14 as it moves through nip 20.

By way of illustration of the size and the weight of a fusing device according to this embodiment of the invention, rollers or steel balls 22 have a diameter of approximately one-eighth inch (0.125 inches). Each ball thus has a contact area on copy sheet 14 of approximately 0.02 inch diameter. The smallest array of balls that would result in an aggregate coverage of copy sheet 14 of conventional size (9 inches wide) is approximately 432 balls. Preferably, the contact area bands formed by the balls on the paper as it moves through the pressure fusing space just overlap so that the entire surface of copy sheet 14 would have pressure applied to it as it passes through nip 20. Assuming that 2,100 pounds per square inch (psi) is required to fuse the toner to copy sheet 14, each ball must transmit a force of approximately 0.8 pounds to copy sheet 14. This requires a total load of approximately 347 pounds to be evenly distributed among all of the balls which is approximately 25% of the total force required by rollers in a conventional pressure fusing device.

In addition to requiring less total force than a conventional pressure fusing device, the present invention is smaller and weighs less. For example, the array of balls described above is approximately 0.7 inches wide by approximately 9 inches long. A housing 18 which contains the balls could, for example, be approximately 1.25 inches wide by approximately 9.5 inches long by approximately 0.50 inches high. A housing with this dimension of a suitable self-lubricating material would weigh approximately 2 pounds. Also by way of illustration, the drive roller 16 of the invention according to this embodiment could be approximately 2.5 inches in diameter, approximately 9.5 inches long, and weigh approximately 13 pounds. Thus, the total size of the fusing device would be approximately 2.5 inches wide, 9.5 inches long, 3.25 inches high and weigh approximately 15 pounds. These estimates do not include the drive motor or mounting frame for the pressure fixing device.

Figure 5:
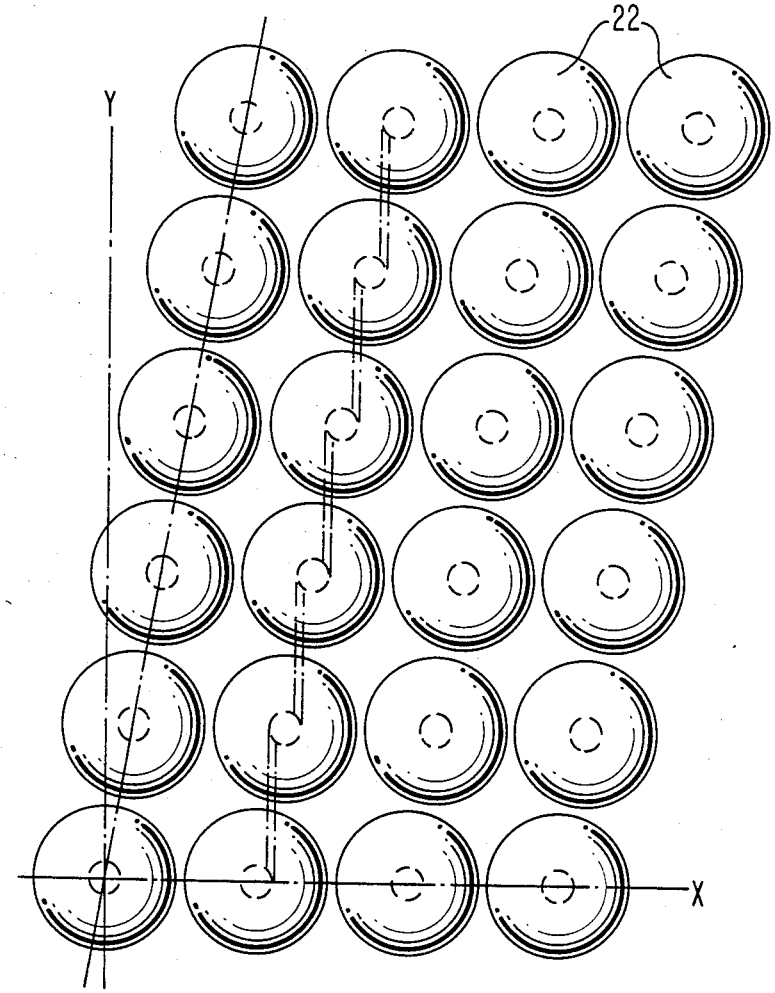
FIG. 5 is a schematic illustration of the positioning of rollers according to one embodiment of the invention.

The array of balls described above represents the smallest space in which the described balls will fit and requires that each of the balls be in physical contact with each adjacent ball. This, however, is undesirable since it causes undue friction and wear on the balls. Accordingly, the balls should be spaced slightly from each other. Too large a space between balls, however, will unduly increase the size of the structure. If, by way of illustration, the balls are assumed to be 0.125 inches in diameter, the diameter of the load area of each ball can be calculated to be approximately 0.02 inches. In order for the contact areas of the balls to barely overlap, which is the preferred form, and for the balls not to physically touch each other, the center of each ball must be offset by approximately 0.02 inches along the X axis and approximately 0.12 inches along the Y axis, as is shown generally in FIG. 5.

In the embodiment of the invention illustrated in FIG. 1, the total force needed to develop the peak unit pressure required to achieve satisfactory fusing of the toner to copy sheet 14 is less than that required to produce the same pressure with the conventional pressure fusing roller arrangements. Accordingly, drive roll 16 can be made of reduced diameter while maintaining suitably low deflection characteristics. The copier can thus be reduced in both required strength and weight. Housing 18 and rollers 22 also are smaller and lighter in weight than the conventional second roll which they replace. The entire pressure fixing device therefore is more compact, lighter, and less expensive than prior art designs.

Although the invention has been described with particular embodiments they are for purposes of example and illustration only. Various modifications will occur to those of ordinary skill in the art, especially with respect to size, positioning, and materials. Accordingly, the invention is intended to be limited only by the following claims.

I claim:

1. A pressure fixing device for a copying machine comprising:

a single driven roller for conveying a copy sheet onto which an image is to be fixed, said single driven roller having a contact area for contacting the surface of the copy sheet and applying a fusing pressure;

a housing adjacent said single driven roller said housing having a length substantially equal to the length of said single driven roller so that a nip is formed between said housing and said single driven roller and a plurality of independent, freely movable rollers retained in said housing, each of said rollers having a contact area for contacting the the copy sheet and applying a fusing pressure to the copy sheet and applying a fusing pressure to the copy sheet, said contact area of each of said independent rollers being substantially less than the contact area of said single driven roller.

2. A pressure fixing device as recited in claim 1 wherein each of said independent, freely movable rollers is not in contact with any other of said independent, freely movable rollers.

3. A pressure fixing device as recited in claim 1 wherein said housing includes a self-lubricating bearing surface against which said independent, freely movable rollers are retained.

4. A pressure fixing device as recited in claim 1 wherein said rollers are balls.

5. A pressure fixing device for a copying machine comprising:

a single driven roller for conveying a copy sheet onto which an image is to be fixed;

a housing adjacent said driven roller and forming a plurality of nips with said single driven roller through which a copy sheet passes;

a plurality of independent, freely movable rollers, retained in said housing, for contacting the copy sheet and applying a fusing pressure to the copy sheet, wherein said independent, freely movable rollers are positioned in said housing so that the contact areas of the rollers on the copy sheet overlap.

6. A pressure fixing device as recited in claim 5 wherein said independent, freely movable rollers are arranged in a plurality of rows and the centerpoint of the independent, freely movable rollers in each row is offset from the centerpoint of the rollers in each of said other rows.

7. In a copying machine which includes a photoconductive surface, charging means for imparting a uniform electrostatic charge to the photoconductive surface, exposure and imaging means for exposing the charged photoconductive surface to a light image of an original to be copied and forming on the photoconductive surface an electrostatic latent image of the original, developer means for developing the latent image, transfer means for transferring the developed latent image onto a copy sheet, and pressure fixing means for permanently fixing the developed latent image on the copy sheet, the improvement wherein said pressure fixing means comprises:

a driven roller for conveying a copy sheet onto which an image is to be fixed;

a housing adjacent said driven roller and forming a plurality of nips with said driven roller through which a copy sheet passes; and a plurality of independent, freely movable ball members retained in said housing for contacting the copy sheet and applying a fusing pressure to the copy sheet.

8. The pressure fixing means recited in claim 7 wherein said ball members are positioned in said housing so that the contact areas of the ball members on the copy sheet overlap.

9. A pressure fixing means as recited in claim 7 wherein each of said ball members is not in contact with any other of said ball members.

10. A pressure fixing device as recited in claim 7 wherein said ball members are arranged in a plurality of rows and the centerpoint of the ball members in each row is offset from the centerpoint of the rollers in each of said other rows.

11. A pressure fixing device as recited in claim 7 wherein sad housing includes a self-lubricating bearing surface against which said ball members are retained.

12. A pressure fixing device for a copying machine comprising:

a driven roller for conveying a copy sheet onto which an image is to be fixed;

a housing comprising a self-lubricating bearing surface, said housing positioned adjacent said driven roller and forming a plurality of nips with said driven roller through which a copy sheet passes;

a plurality of independent freely movably ball members retained in said housing adjacent said self-lubricating bearing surface, said ball members contacting the copy sheet and applying a fusing pressure to the copy sheet;

said ball members positioned in said housing so that each of said ball members is free from contact with any other of said ball members and wherein said ball members are arranged in a plurality of rows, the centerpoint of the ball members in each row is offset from the counterpoint of the rollers in each of said other rows so that the contact areas of said ball members on the copy sheet overlap.

* * * * *